US006182595B1

(12) United States Patent
Morris

(10) Patent No.: US 6,182,595 B1
(45) Date of Patent: Feb. 6, 2001

(54) PIVOTING DOCKING PLATFORM FOR PERSONAL WATERCRAFT

(76) Inventor: George W. Morris, 32329 Island View Rd., Gravois Mill, MO (US) 65037

( * ) Notice: Under 35 U.S.C. 154(b), the term of this patent shall be extended for 0 days.

(21) Appl. No.: 09/493,968

(22) Filed: Jan. 28, 2000

(51) Int. Cl.[7] ..... B63B 35/40
(52) U.S. Cl. ..... 114/259; 405/1
(58) Field of Search ..... 114/44, 45, 258, 114/259, 365, 366, 368, 375, 373; 405/113

(56) References Cited

U.S. PATENT DOCUMENTS

| | | | | |
|---|---|---|---|---|
| 2,754,017 | | 7/1956 | Hart et al. | 214/505 |
| 3,114,535 | | 12/1963 | Burch | 254/127 |
| 3,227,292 | | 1/1966 | Jacobs | 214/1 |
| 3,895,592 | | 7/1975 | King | 114/45 |
| 5,016,893 | | 5/1991 | Hart, Jr. | 280/35 |
| 5,133,275 | * | 7/1992 | Maurizio | 114/373 |
| 5,184,913 | | 2/1993 | Meriwether | 405/1 |
| 5,249,545 | | 10/1993 | Gettman | 114/259 |
| 5,311,970 | | 5/1994 | Basta | 187/11 |
| 5,425,322 | | 6/1995 | Ziober | 114/44 |
| 5,483,912 | * | 1/1996 | Thomas | 114/259 |
| 5,636,587 | * | 6/1997 | Klimowicz | 114/259 |
| 5,839,851 | | 11/1998 | Norfolk et al. | 405/3 |
| 5,855,180 | | 1/1999 | Masters | 114/263 |
| 6,038,994 | * | 3/2000 | Ford et al. | 114/259 |

* cited by examiner

*Primary Examiner*—Stephen Avila
(74) *Attorney, Agent, or Firm*—Richard J. Grundstrom

(57) ABSTRACT

A pivoting docking platform for personal watercraft of this invention includes a support tube, or equivalent structure, that is rigidly attached to and extends perpendicularly from a dock or other structure near and above the water where a personal watercraft is used. A frame is pivotally attached to the support tube. The frame pivots between an upward parked position and a downward receiving position. The parked position positions the frame and the personal watercraft parked thereon, parallel to the edge of the dock or other structure and parallel to the water surface. A pair of skids in a parallel spaced relationship are attached to a top of the frame. The skids receive and holds a personal watercraft on the frame. The skids have a receiving end and a forward end. The receiving ends of the skids are positioned beneath the water surface when the frame is in the receiving position. A personal watercraft can be driven onto the receiving end of the skids when the frame is in the receiving position. One or more stop mechanisms limits the pivot of the frame by stopping the downward pivoting of the frame at the receiving position and stopping an upward or forward pivoting of the frame at the parked position. The stop mechanism is typically fixed to the support tube to limit the frame's pivoting action. In conjunction with the stop mechanism, at least one lock mechanism will typically be used to lock the frame.

11 Claims, 8 Drawing Sheets

PIVOTING DOCKING PLATFORM FOR PERSONAL WATERCRAFT

BACKGROUND OF THE INVENTION

The present invention relates to a pivoting docking platform for personal watercraft.

Personal watercraft are very popular and are gaining more popularity every year. The use is wide spread and they can be found on almost all bodies of water used for boating. They are typically used to provide entertainment, but they are also a mode of transportation over water. As fun as they are, there are some problems associated with their use.

One problem is the boarding and off boarding. Since they are a small watercraft, they easily tip to one side as they are boarded or off boarded. This often results in the watercraft tipping over, and/or the person getting wet. They are not that easy to board, unless they are in very shallow water or are being held in a stable position by someone or something. This invention provides a means of easily boarding a personal watercraft without the craft tipping and without the person getting wet. The watercraft is held in a stable horizontal position out of the water so a person can easily board and off board the craft.

Another problem with the personal watercraft is docking and parking. The personal watercraft is a lot smaller than a typical boat, so boat slip having parallel docks on each side of the craft are to big. As a result, the personal watercraft is tied up along side the dock. In this position, the wave action and wind pounds the craft against the dock. Damage can be done to both the dock and the craft. The pivoting docking platform for personal watercraft overcomes these problems.

Often the personal watercraft is simply beached. This provides a simple solution for several problems. The watercraft is parked in a stable position. The wind and waves are not much of a factor. However, the bottom of the craft is scrapped against sand, mud, or rocks at the beached area which can damage the underside of the watercraft. The shallow water also makes it easy to board and off board because the craft is being held stable by the bottom of the water. But, the person has to get wet to get off and on and the person has to pull the craft off the bottom in order to board and to propel the craft. Plus, the beached watercraft is often not conveniently located. It is in the way of swimmers, and fishermen and it can be a troublesome location in general. The pivoting docking platform for personal watercraft overcomes these problems. It provides a convenient location for docking and parking. It provides a stable docking position to board and off board. The person boarding does not have to use any strength to get it going nor does the person need to get wet. The watercraft is boarded and launched with a simple motion. Docking the personal watercraft is as simple as driving the craft onto the pivoting docking platform.

Accordingly, it is an object of the present invention to provide a pivoting docking platform for personal watercraft that provides a convenient location for docking, parking and launching a personal watercraft. With the pivoting docking platform for personal watercraft of this invention it has been found that it can be positioned on a dock, retaining wall or any other structure near the water, at a location that is out of the way but having easy access. This provides more enjoyment of the personal watercraft in that a person does not need to worry about damage to the personal water craft, it provides easy access, and a specific designated location for docking, parking and launching. Plus the advantage of easily boarding and off boarding.

Another object of the present invention is to provide a pivoting docking platform for personal watercraft constructed to provide a means of docking and parking the personal watercraft in a position where the personal watercraft is out of the water. The pivoting docking platform for personal watercraft of this invention pivots during docking and the pivot motion positions the personal watercraft in a horizontal position above the water surface. This eliminates the action of the waves and wind while docked and while trying to board or of board the craft.

A further object of the present invention is to provide a pivoting docking platform for personal watercraft adapted for holding the personal watercraft in a stable position for loading and unloading thereby increasing the enjoyment on the use of a personal watercraft. The personal watercraft, with the pivoting docking platform of this invention, is held in a stable horizontal level position at a very convenient height near the dock or other structure for boarding and off boarding. The person can board and off board without the personal watercraft tipping or leaning nor does the person need to get into or touch the water.

Still another object of the present invention is to provide a pivoting docking platform for personal watercraft designed and constructed with materials that make a long lasting product that is easily repaired, has interchangeable parts to minimize inventories, and to make shipping to and assembly at the site easy. The preferred embodiment herein described was selected for cost, durability and aesthetics.

To accomplish the foregoing and other objects of this invention there is provided a pivoting docking platform for personal watercraft and more particularly to a pivoting frame with receiving skids attached to a dock or other structure at a convenient location for receiving, docking and parking a personal watercraft.

SUMMARY OF THE INVENTION

The pivoting docking platform for personal watercraft of this invention includes first a support tube, or equivalent structure, that is rigidly attached to and extends perpendicularly from a dock or other structure near and above the water where a personal watercraft is used. A frame is pivotally attached to the support tube. The frame pivots between an upward parked position and a downward receiving position. The parked position positions the frame and the personal watercraft parallel to the edge of the dock or other structure and parallel to the water surface. A pair of skids in a parallel spaced relationship are attached to a top of the frame. The skids receive and holds a personal watercraft. The skids have a receiving end and a forward end. The receiving ends of the skids are positioned beneath the water surface when the frame is in the receiving position A personal watercraft can be driven onto the receiving end of the skids when the frame is in the receiving position. One or more stop mechanisms limits the pivot of the frame by stopping the downward pivoting of the frame at the receiving position and stopping an upward or forward pivoting of the frame at the parked position. The stop mechanism is typically fixed to the support tube to limit the frame's pivoting action. In conjunction with the stop mechanism, at least one lock mechanism will typically be used to lock the frame in the parked position. Provisions are included to automatically lock the frame in the parked position when a personal water craft is driven upon said skids and the frame to pivots from the receiving position to the parked position. A skid stop pad is included at the forward end of the skids. The skid stop pads slows and stop the forward momentum of the personal watercraft as it is driven onto the skids.

The above mentioned and other objects, and features of the present invention will be better understood and appreciated from the following detailed description of the main embodiment thereof, selected for purposes of illustration and shown in the accompanying drawings.

DETAILED DESCRIPTION

Figure 1:
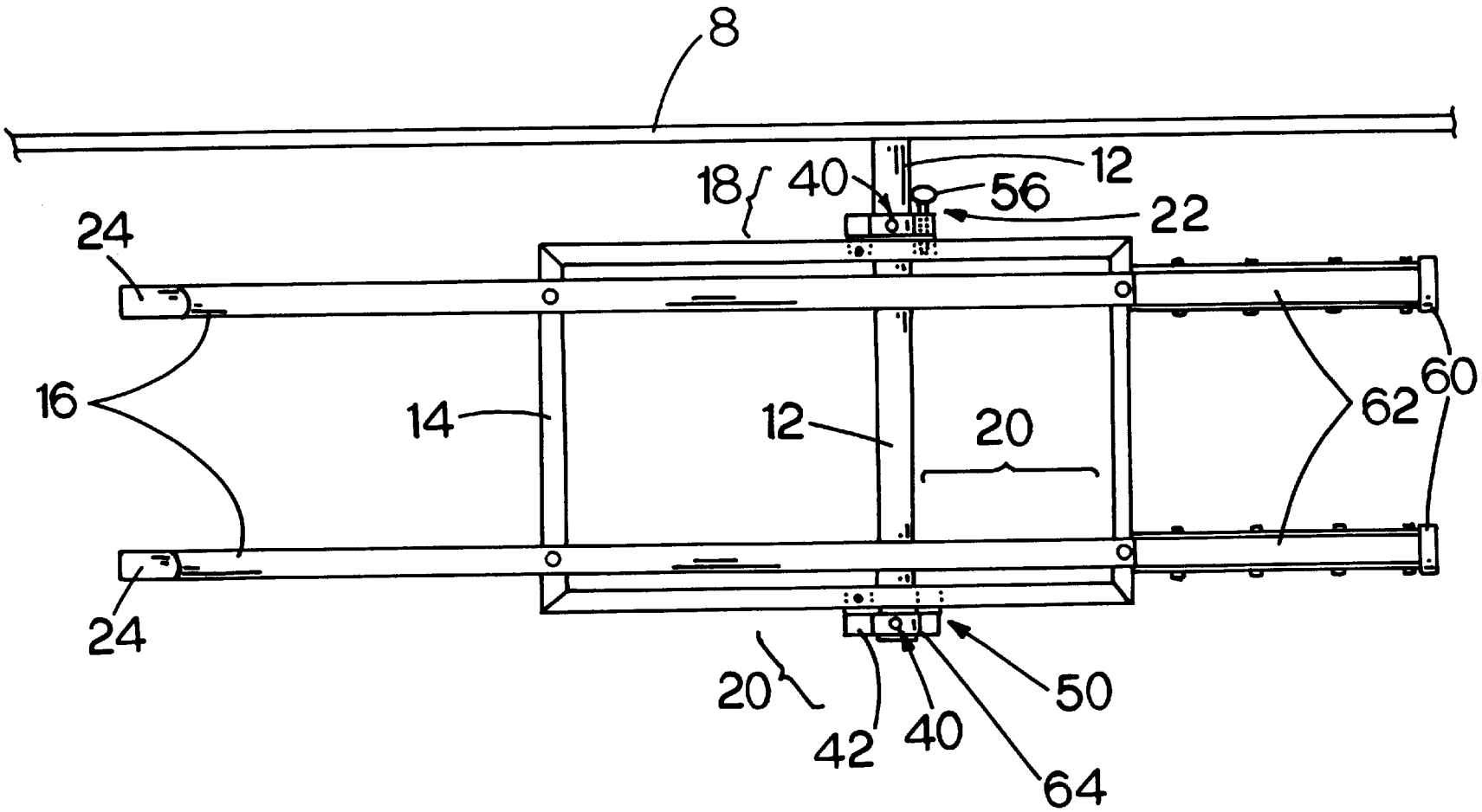
FIG. 1 is a top view showing a representation of a preferred embodiment of the pivoting docking platform for personal watercraft of this invention.

Referring now to the drawings there is shown the preferred embodiment for the pivoting docking platform for personal watercraft 10 of this invention.

The pivoting docking platform 10 is used for parking and storing a personal watercraft at the dock and point of boarding and use. The pivoting docking platform for personal watercraft 10 is attached to a dock or other structure at a convenient location for easy access. The pivoting docking platform for personal watercraft 10 allows a person to easily board the watercraft in a parked position. Once the personal watercraft 6 is boarded, a simple pivoting motion is initiated by the person. The pivoting docking platform pivots downward and the personal watercraft 6 easily slides off into the water. In a lower position, or receiving position, the receiving end 24 of the pivoting docking platform is beneath the water line. To dock the personal water craft, a person simply drives the personal watercraft 6 onto the platform. The forward momentum of the personal watercraft on the platform causes the pivoting docking platform to pivot forward into a parked position. In the parked position, the personal watercraft is positioned out of the water and is readily boarded or off boarded at the dock by a person or persons.

The pivoting docking platform for personal watercraft 10, in the most simple of explanations, has a support tube 12, a frame 14, a pair of skids 16, at least one stop mechanism 18, and a lock mechanism 22. The support tube 12 attaches to a dock 8 or other supporting structure. Note for simplicity, throughout this description the term dock will be used, but it is intended that the support tube can be attached to and extended from any structure, including but not limited to docks, buildings, boat houses, wharfs, water or wave breaks, retaining wall, or any type of structure near, above or located in the vicinity of water in which a personal watercraft can be used.

The support tube 12 extends outward perpendicularly from the dock 8. A frame 14 is pivotally attached to the support tube 12. The frame 14 is generally rectangular or square in shape. In general terms, it is typically about as wide as a personal watercraft and about one and a half times long as wide. The frame can pivot between a downward receiving position and an upward parked position. A stop mechanism 18 limits the frames pivot about the support tube 12. There is a means to stop the pivot in the downward position or receiving position and another means to stop the pivot in the upward position or parked position. A pair of skids 16 are attached to the top of the frame. The skids 16 receives the personal watercraft 6 and holds or cradles it in a parked position. In the receiving position, a receiving end 24 of the skids 16 are positioned beneath the water. In this position, a personal watercraft 6 can slide off the skids 16 into the water and can be driven onto the skids 16 for parking the personal watercraft. A locking mechanism 22 locks the frame in the parked position with the personal watercraft in a horizontal position, or parked position, out of the water and parallel to the dock edge.

The preferred embodiment and the best mode contemplated of the pivoting docking platform for personal watercraft 10 of the present invention are herein described. However, it should be understood that the best mode for carrying out the invention hereinafter described is offered by way of illustration and not by the way of limitation. It is intended that the scope of the invention include all modifications which incorporate its principal design features.

Figure 2:
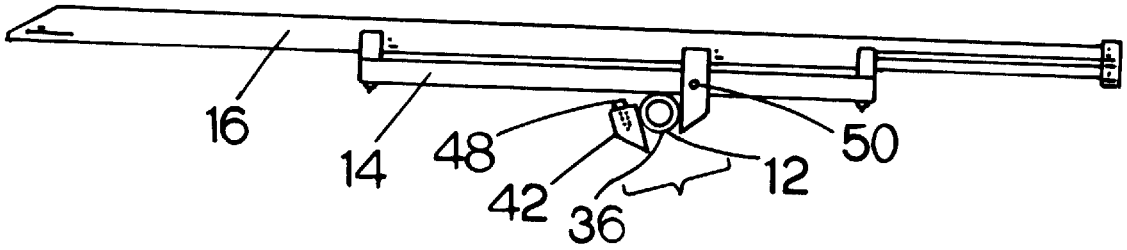
FIG. 2 is a side view showing a representation of a preferred embodiment of the pivoting docking platform for personal watercraft.
Figure 3:
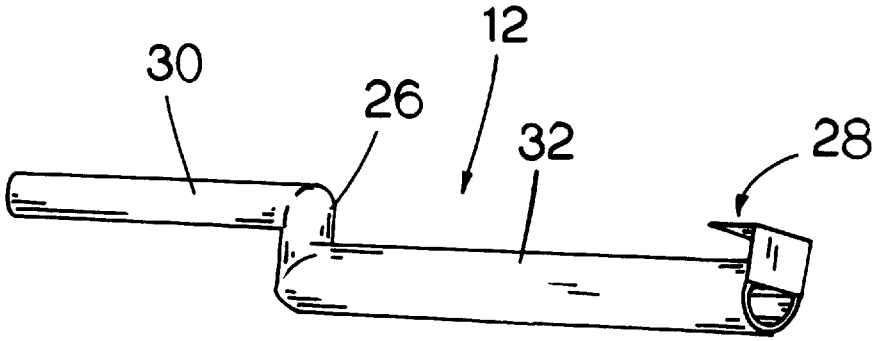
FIG. 3 is an isometric view showing a support tube having an offset for attaching the pivoting docking platform for personal watercraft to a dock or other structure.
Figure 4:
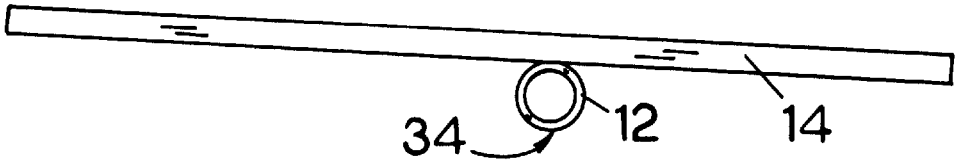
FIG. 4 is a side view showing one method or one embodiment of pivotally attaching a frame to a support tube making a frame pivoting docking platform for personal watercraft.
Figure 9:
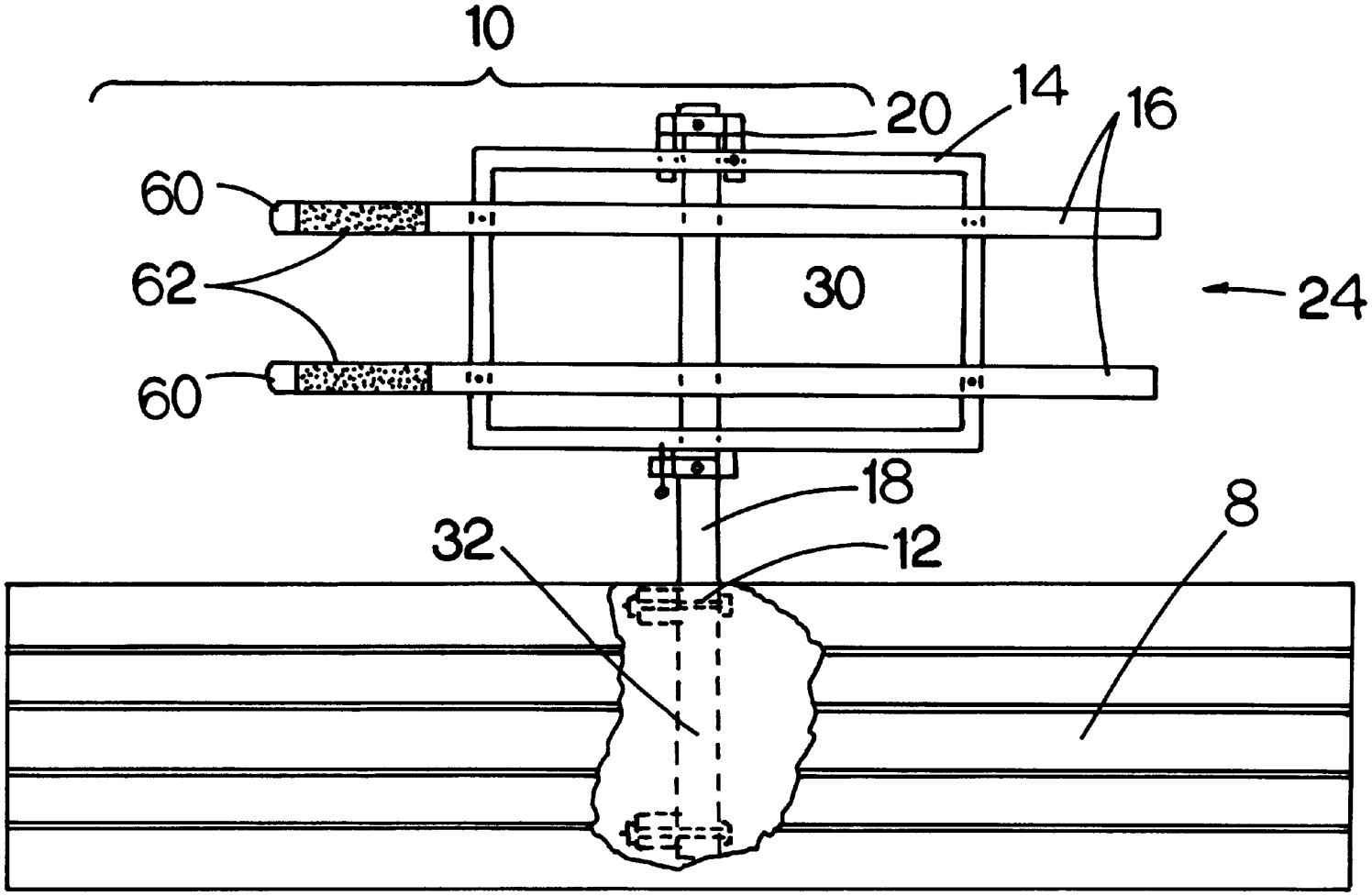
FIG. 9 shows an example of how the pivoting dock platform for personal watercraft can be attached to a dock.
Figure 10:
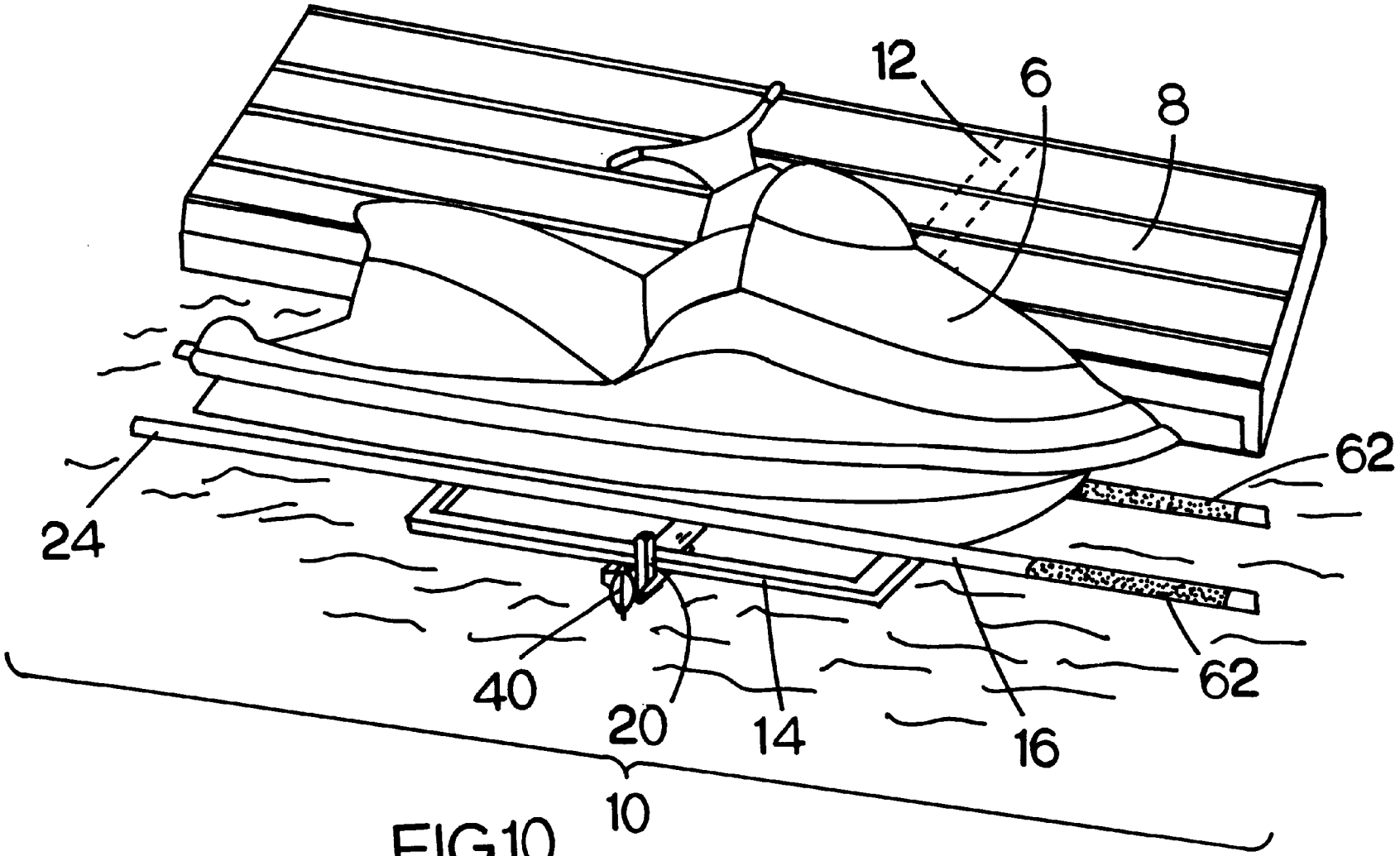
FIG. 10 is an isometric view showing a personal watercraft on the pivoting docking platform in the parked position.

A support tube 12, in the preferred embodiment, consists of a round tube like structure attached to and extending perpendicular outward from a dock 8. In the preferred embodiment and best mode contemplated, the support tube 12 consists of a steel pipe. The steel pipe used in the preferred embodiment is 3 inches in diameter and approximately 8 feet long. Part of the support tube 12 is attached to the underside of the dock and approximately 4 feet extends outward for receiving the frame 14. The support tube 12 can be a straight pipe or there can be an offset 26 for proper positioning on the dock. As illustrated in FIG. 2, section 30 is the portion extending perpendicular from the dock 8 and where the frame 14 is pivotally attached. The portion 32 is attached to the under side of the dock. An offset 26 provides a means of properly placing section 30, and thus the frame 14, at the right height above the water. The amount of the offset 26 is determined by the particular structure. The height above the water should be such that when the frame 14 is in the parked position, the bottom of a personal watercraft parked thereon, should be at about the same height as the dock surface and parallel to the water and the edge of the dock. This allows easy access onto and off the personal watercraft as it is parked. A bracket 28 can be included for securing an end of the support tube 12 to the dock. It should also be considered that other structure and design will also work and function. The critical design feature is that a section 30 is extending perpendicularly outward from the dock 8 for pivotally receiving the frame 16. The section 32 that attaches to the dock can be square or have a flat surface to better secure the support tube 12 to the dock. Typically, the support tube 12 is simply bolted to the dock and/or some sort of mounting bracket can be used as desired or as needed. FIG. 9, shows a typical means of bolting the section 32 of the support tube 12 to the underside of dock 8. Bolts ??

The frame 16 in the preferred embodiment is made from steel 2 inch square tubing with an outside frame dimension of approximately 30 inches wide and 48 inches long. The frame 16 would consist of at least a forward member, a rear member and two side members. The dimensions and material can be altered and modified as desired as long as the frame 14 can be pivotally attached to the support tube 12 and have structural strength to receive skids 16 and support a personal watercraft.

In the preferred embodiment, one or more collar(s) 34 are used to pivotally attach the frame 14 to the support tube 12. The collar or collars 34 are attached to the lower side of the frame, FIG. 2. Typically the collar or collars are welded to the side members of the frame approximately 20 inches from the forward edge of the frame 14. However, different configurations may alter this measurement. If one collar 34 is used it will resemble a steel pipe. The steel pipe collar 34 would extend across the width of the frame 14 and be welded to the two outer members of the frame 14. In this configuration, the collar 34 would add structural support to the frame. In the preferred embodiment, two collars 34, having a width of approximately 2 inches, are used. One collar 34 would be attached, typically by welding, to each of the frame 14 outer members. The collars 34 in the preferred embodiment, whether a single collar or two collars are used, have a diameter of 3.5 inches. This allows the collar(s) 34 to slip over the support tube 12, which in the preferred embodiment, has a three inch diameter. In this manner, the frame 14 can readily pivot on the support tube 12.

A pivot device such as a hinge like device would also function in place of the collar. This feature is not illustrated because a hinge like device is commonly known and understood by virtually everyone and especially by one skilled in the art. The pivot device would simply be attached to the bottom of the outside members of frame 14 and to the support tube 12 in place of collars 34. The pivot device would allow the frame to pivot between the receiving position and the parked position. One advantage of this arrangement is that it can be set up such that the hinged would be closed and would assist in stopping the frame at the parked position. This is an alternative method but it is not the preferred embodiment. There are more advantages using the collar 34, and is thus the preferred embodiment.

At least one stop mechanism 18 would have to be used to limit the pivot of the frame 14 on the support tube 12. The stop mechanism 18 would stop the pivot in a lower position or receiving position, and at an upper position or parked position. Without the stop mechanism, the frame 14 could pivot completely around the support tube 12 in the preferred embodiment as described.

Figure 5:
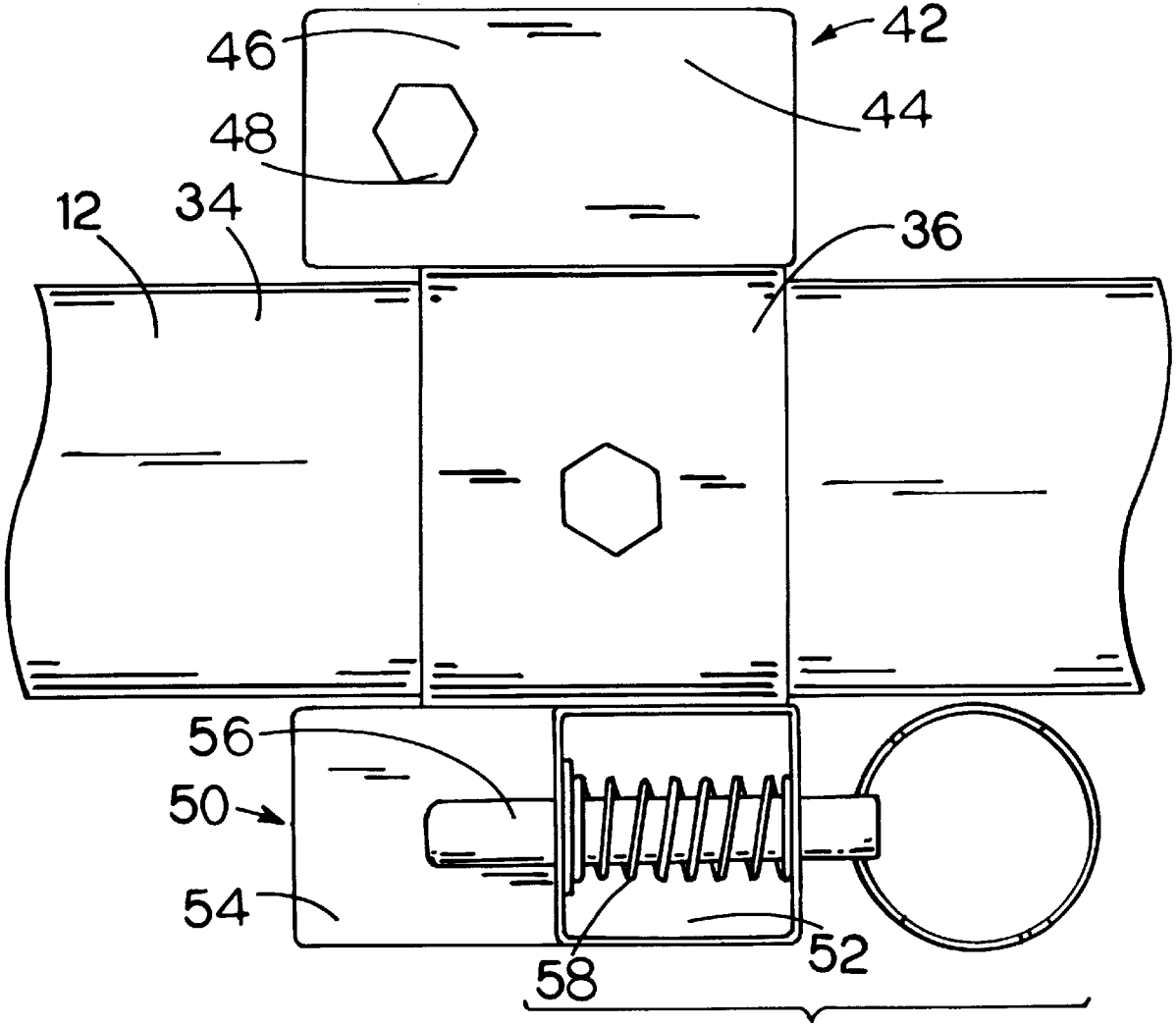
FIG. 5 is a top view of one embodiment of a left side stop mechanism for the pivoting docking platform for personal watercraft of this invention.
Figure 6:
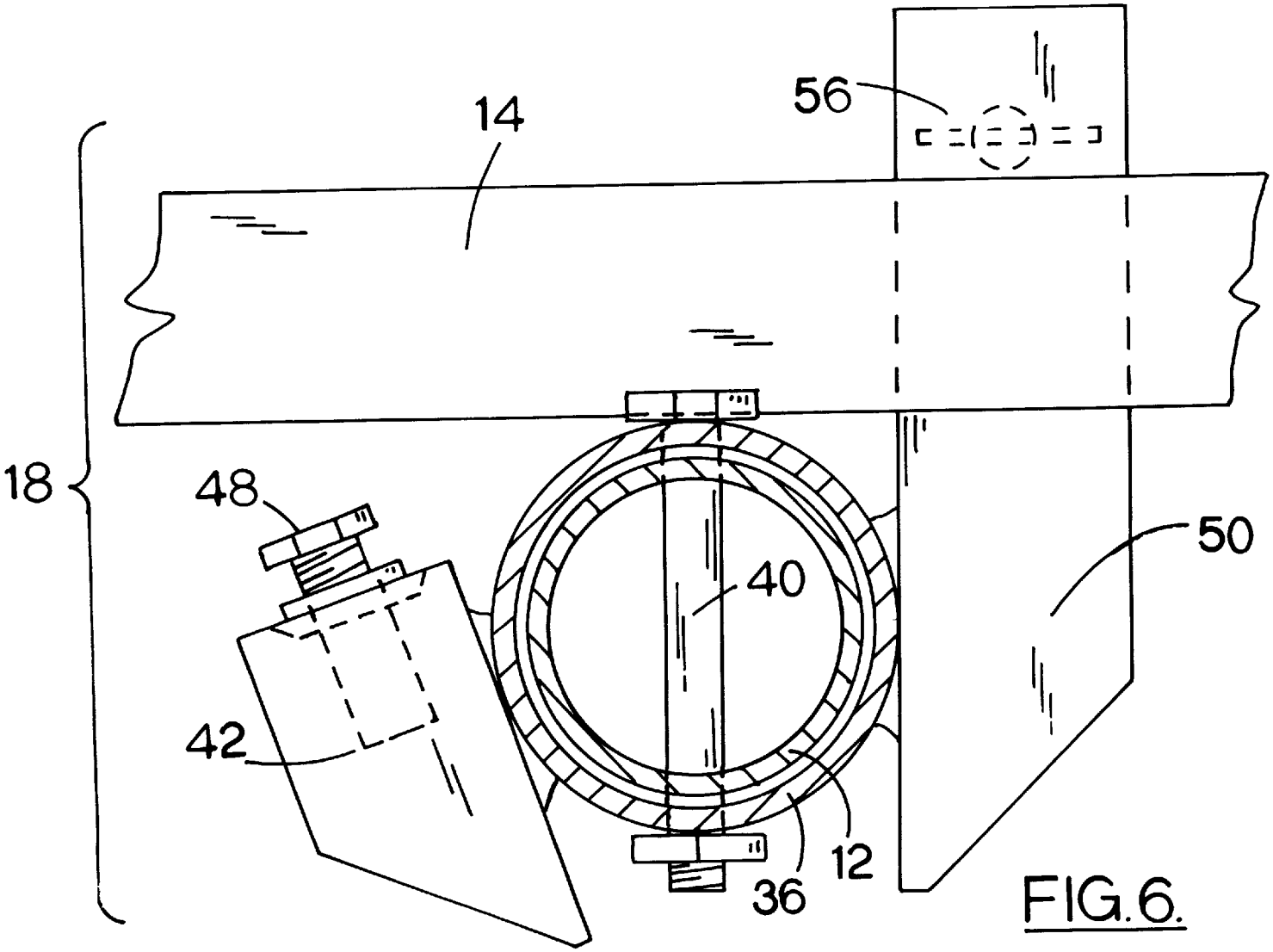
FIG. 6 is a side view of FIG. 5.
Figure 7:
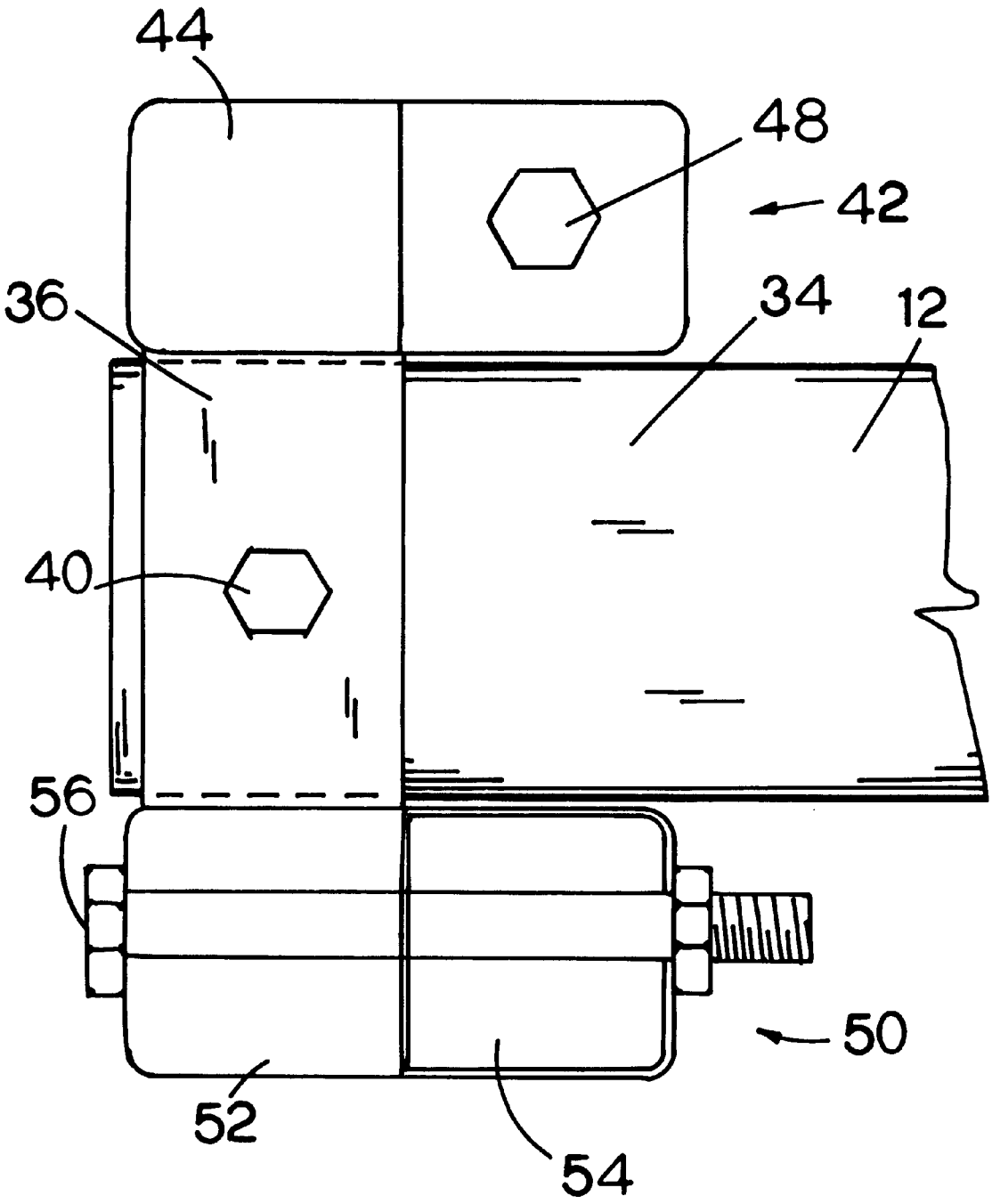
FIG. 7 is a top view of one embodiment of a right side stop mechanism for the pivoting docking platform for personal watercraft of this invention.
Figure 8:
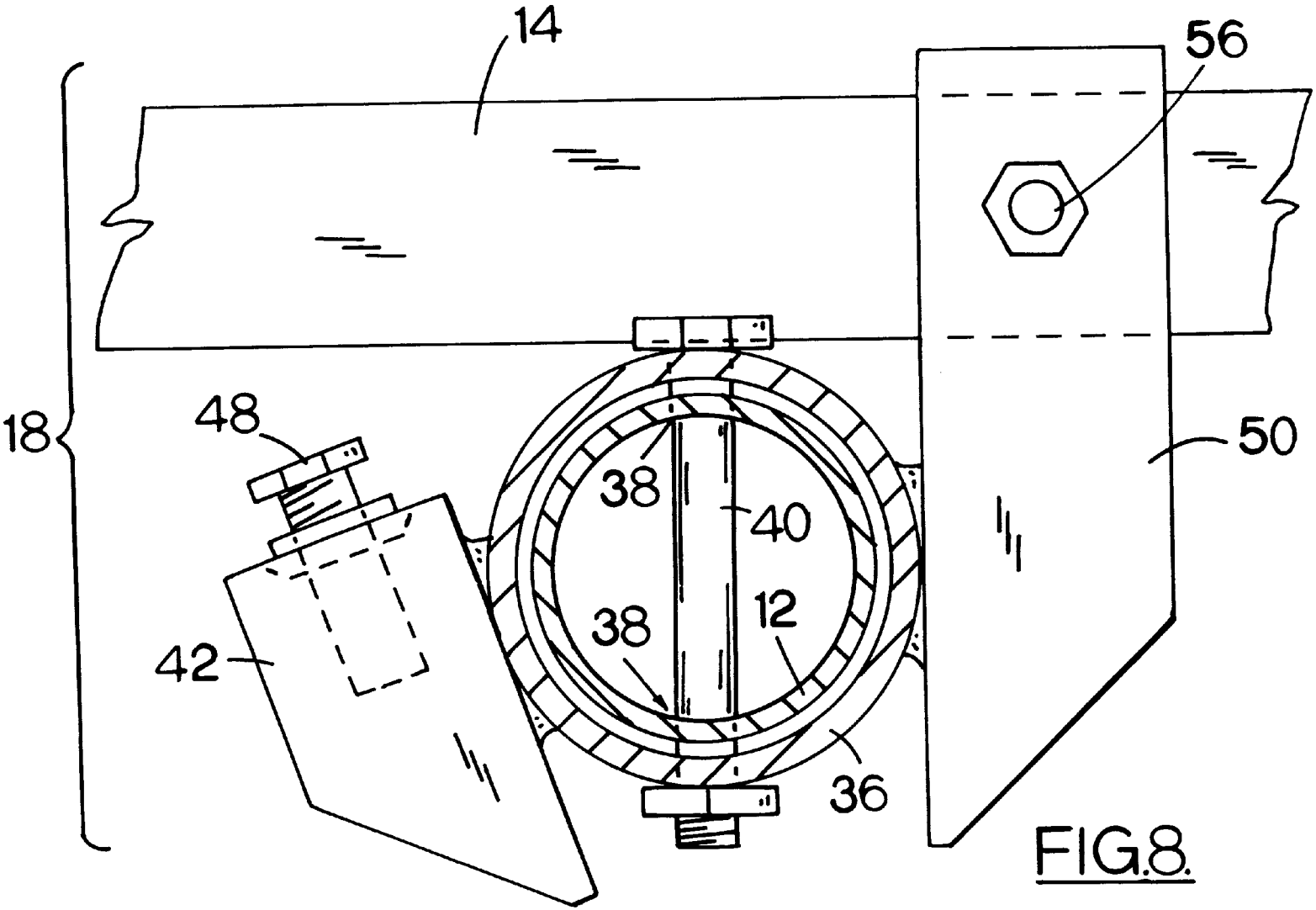
FIG. 8 is a side view of FIG. 7.

In the preferred embodiment, two stop mechanisms 18 and 20 are used. Stop bracket 18 being on the inner side or left side as illustrated in FIGS. 5 and 6, and stop bracket 20 being on the outer side or right side as illustrated in FIGS. 7 and 8. These brackets 18 and 20 are identical in description of the components, but are arranged in an opposite and reciprocal relationship, FIGS. 5–8. There would be one attached to the support tube 12 on each side of frame 14. This arrangement provides greater stability and strength in both the parked and receiving positions.

The stop mechanism 18, in the preferred embodiment, has an attachment collar 36. The attachment collar 36 is physically similar to collar 34, in that it slides over the support tube 12. However, the attachment collar 36 is physically fixed to the support tube 12. In the preferred embodiment, the attachment collar 36 is simply bolted in a fixed position on the support tube 12 by bolt 40. Bores 38 would be provided through the attachment collar 36 and through the support tube 12 for the bolt 40.

Attached to one side of the attachment collar 36 is a down stop bracket 42. The down stop bracket 42 stops the pivot of frame 14 in the lower or receiving position. The down stop bracket 36, in the preferred embodiment, is made from two pieces of 2 inch square tubing, 44 and 46. The down stop bracket 42 contacts the lower side of the outer frame members on frame 12. As such, the down stop bracket 42 must be positioned beneath the frame 12 as it pivots about support tube 12. The first piece of two inch square tubing 44 is welded to the attachment collar 36. The second piece of two inch square tubing 46 is attached to the side of piece 44. This positions the second piece 46 under the frame 12 when the stop mechanism 18 is positioned on the support tube 12 adjacent to collar 34 on frame 14. The clown stop bracket 42 would be positioned on the attachment collar 34 such that the frame 14 is positioned with the receiving ends 24 of skids 16, attached to frame 14, are positioned beneath the water surface.

The down stop bracket 42 can also be equipped with a down stop adjustment bolt 48. The top surface of the down stop bracket 42, that contacts the frame 12, would be have provisions for receiving a bolt, such as a threaded bore or smooth bore with a welded nut thereon. The adjustment bolt 48 would provide a means of adjusting the lower limit of the frame's 14 pivoting motion, and thus the lower positioning of the receiving ends 24 of skids 16. Generally, the adjustment bolt 48 would be screwed into the threaded bore or welded nut and locked in place with another nut. The head of the adjustment bolt 40 would be contacting the lower side of the side member of frame 14 as it pivoted downward in the receiving position.

Attached to the opposite side of the attachment collar 36, from the down stop bracket 42, there is an up stop bracket 50. The up stop bracket stops the frame's 14 upward or forward pivot and stops it in the parked position. The frame 14, in the parked position, is parallel to the water surface and parallel to the edge of the dock 8. The up stop bracket 50, like the down stop bracket 42, must be positioned beneath the side member of the frame 14. To do this, the up stop bracket 50, in the preferred embodiment, is also made with two pieces of square tubing 52 and 54. The first piece of square tubing 52 is attached, typically by welding, to the attachment collar 36 opposite the down stop bracket 42. it typically extends upward adjacent to the frame 14, and can also be called a lock mechanism bracket because a lock mechanism can be easily accommodated with or within this piece. The second piece 54 is attached to the side of first piece 52 for placement of the second piece 54 under the frame 14 when the stop mechanism 18 is positioned on the support tube 12 adjacent to the collar 34 on frame 14. Obviously, both pieces 52 and 54 would be properly positioned to stop the frame 14 in the proper position.

At least one lock mechanism 22 would be incorporated with the up stop bracket 50 to lock the frame in the parked position. Typically, in the preferred embodiment, the lock mechanism 22 would be incorporated on the stop mechanism 18 located on the dock side of the frame 14. In one embodiment, the lock mechanism 22 consists of a spring loaded locking pin. A locking pin 56 would extend through a bore through the first square tubing 52 or also called a lock mechanism bracket, on the up stop bracket 50. A spring 58 would be positioned on the shaft of the locking pin 56 within the inside of the first square tubing 52. The spring 58 would provide bias to keep a section of the locking pin 56 extending outward, towards the frame 14. The locking pin 56 would engage a hole or bore properly located in the side of the outer side member of frame 14. A sloped bracket or ramping devices can be added to allow the locking pin to be retracted by the frame as it pivots into the parked position. Once the frame 14 reaches the parked position the locking pin would automatically engage the bore or hole in the frame 14. This provision allows the frame to be automatically locked in the parked position when a personal water craft pivots the docking platform forward. To release the frame 14 and launch the personal watercraft, the locking pin 56 is simple pulled outward to disengage the pin from the frame.

A second lock mechanism 64 can be included on the stop bracket 20 on the outer side of the support tube 12. The second lock mechanism 64 can function in the same manner as the first. In another embodiment, there is simply a slide pin or bolt 56 that can be lock into the frame 14 to lock the frame in the parked position. This arrangement provides added security and rigidity while in the parked position. Provisions can be included for a pad lock or other locking device. This would be used for a longer term storage and to provide some level of security, in that the pivoting docking platform for personal watercraft can be locked in the parked position.

If a square or other configuration of support tube 12 were used, the collar 36 would typically take the shape of the support tube, but slightly larger to slide over the support tube 12. If a square or rectangular tube were used, the collar's shape would also help stabilize the stop mechanism 18 and 20, but they would still be bolted in position. This is mentioned as an alternative arrangement that is considered within the scope of the invention. It is not illustrated because, it would be readily understood by anyone and especially anyone skilled in the art and with any kind of mechanical knowledge.

A pair of skids 16 are attached to the top of frame 14. Each skid 16 has a receiving end 24 and a forward end 60. The receiving end 24 is lowered into the water for receiving and unloading a personal watercraft. The skids 16 pivot with the frame 14 which is pivotally attached to the support tube 12. The skids 16 are in a parallel spaced relationship to each other. Generally speaking, the two skids 16 will be spaced apart wide enough to accept a personal watercraft without the fear of falling through or going between the skids 16. In the preferred embodiment, the skids 16 are spaced apart approximately 19 inches on center. In the preferred embodiment, the skids 16 are made from 3 inch schedule 40 PVC pipe nine feet long, and which are bolted onto frame 14. The PVC pipe and frame 14 are pre-drilled to accept a bolt. The schedule 40 pipe provides the needed strength to support a personal watercraft. Other material, such as a steel pipe, steel tubing, or wood skids could also be used as skids 16 without departing from the scope of this invention. The PVC pipe is considered the best mode contemplated because it is light weight, is easily shipped, is easily worked, has the required strength, is readily replaced with common materials, provides a level of protection to the watercraft as it slides along the surface, and provides a level of safety should an out of control personal watercraft strike the skids.

The forward end 60 of at least one of the skids 16 contains a skid stop pad 62. In the preferred embodiment both skids 16 contain a stop skid pad 62. The skid stop pad(s) slow and stop a personal watercraft's forward motion when the personal water craft is driven onto the skids. In a simple embodiment, the stop skid pads are simply pieces of carpet screwed onto the forward ends 60 of skids 16.

This description has described the configuration of the preferred embodiment and best mode contemplated. There are also many other configurations that fall within the general description and within the scope and limitation of the claims. It is intended that all variations and modifications are within the scope of this invention, as long as the principle features as claimed are meet. One such embodiment would be to use a square support tube 12 with a pivot device, such as a hinge type arrangement, attached between the support tube 12 and frame 14. The stop mechanism would of course have to be modified to function with this alternative configuration. Many other configurations and variations are too numerous to list. The claims and not the description of the preferred embodiment and best mode contemplated, should be considered as the limiting factor. This preferred embodiment is considered the best mode contemplated for several reason. One is the mass production of the parts. Parts are readily interchangeable between various models and are readily changed if replacement is necessary. Another is the ease of shipment to the site and assembly of the unit once at the location of use. All parts can be readily shipped and easily assembled. The configuration as described, has also proven to be very dependable, reliable, and long lasting. The finished product has a very pleasing appearance compared to other configuration. These and other reasons make the preferred embodiment as described, the best mode contemplated.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A pivoting docking platform for a personal watercraft comprising:

a support tube rigidly attached to and extending perpendicularly from a dock or other structure;

a frame pivotally attached to said support tube, said frame pivoting between an upward parked position parallel to said dock or other structure and to the water's surface, and a downward receiving position;

a pair of skids in a parallel spaced relationship attached to a top of said frame, said skids having a receiving end and a forward end, said receiving end being positioned beneath a water line when said frame is in said receiving position, and said personal watercraft being driven upon said receiving end of said skids when said frame is in said receiving position;

at least one stop mechanism fixed and attached to said support tube, said step mechanism limiting the pivot of said frame by stopping a downward pivoting of said frame at said receiving position and stopping an upward or forward pivoting of said frame at said parked position parallel to said dock or other structure; and at least one lock mechanism attached to said stop mechanism to lock said frame in said parked position.

2. The pivoting docking platform for personal watercraft as set forth in claim 1 further comprising one or more skid stop pad(s) attached to said forward end of said skids, said skid stop pad slowing and stopping a personal watercraft's forward motion when said personal watercraft is driven onto said skids.

3. The pivoting docking platform for personal watercraft as set forth in claim 1 further comprising one or more collar(s), said collar(s) attached to a bottom of said frame, said collar(s) sliding over said attachment tube and allowing said frame to pivot on said attachment tube.

4. The pivoting docking platform for personal watercraft as set forth in claim 1 further comprising one or more pivot devices, said pivot device resembling a hinge attached to a bottom of said frame and to said support tube, said pivot device allowing said frame to pivot on said attachment tube.

5. The pivoting docking platform for personal watercraft as set forth in claim 1 in which said stop mechanism comprises:

an attachment collar, said attachment collar sliding over and bolted in a fixed position on said support tube, a down stop bracket rigidly attached to an outer surface of said attachment collar to stop said frame in said receiving position; and an up stop bracket rigidly attached to said attachment collar to stop said frame in said parking position.

6. The pivoting docking platform for personal watercraft as set forth in claim 5 further comprising a down stop adjustment bolt screwable into a top of said down stop bracket, said down stop adjustment bolt providing a means of adjusting a lower limit of said frame in said receiving position.

7. The pivoting docking platform for personal watercraft as set forth in claim 1 in which said lock mechanism comprises a lock bracket fixed to said stop mechanism, said lock bracket extending upward adjacent to said frame when said frame is in said parked position, and a lock pin extending through said lock bracket and engaging said frame to lock said frame in said parked position.

8. The pivoting docking platform for personal watercraft as set forth in claim 7 further comprising a spring, said spring providing bias to said lock pin to bias said lock pin outward toward said frame.

9. A pivoting docking platform for a personal watercraft comprising:

a support tube rigidly attached to a dock or other structure, with a round section extending outward perpendicularly from said dock or other structure;

a frame having a forward member, a rear member and two side members, said frame having one or more collars attached to a bottom side of said side members of said frame, said collar slidable over said support tube and used to pivotally attach said frame to said support tube, said frame pivoting between an upward parked position parallel to said dock or other structure, and a downward receiving position;

a pair of skids in a parallel spaced relationship attached to a top of said frame, said skids having a receiving end and a forward end, said receiving end being positioned beneath a water line when said frame is in said receiving position, and said personal watercraft being driven upon said receiving end of said skids when said frame is in said receiving position;

one or more skid stop pad(s) attached to said forward end of said skids, said skid stop pad slowing and stopping a personal watercraft's forward motion when said personal watercraft is driven onto said skids;

at least one stop mechanism fixed and attached to said support tube, said stop mechanism limiting the pivot of said frame by stopping a downward pivoting of said frame at said receiving position and stopping an upward or forward pivoting of said frame at said parked position parallel to said dock or other structure, said stop mechanism comprising: an attachment collar, said attachment collar sliding over and bolted in a fixed position on said support tube, a down stop bracket rigidly attached to an outer surface of said attachment collar to stop said frame in said receiving position; and an up stop bracket rigidly attached to said attachment collar to stop said frame in said parking position; and at least one lock mechanism attached to said stop mechanism to lock said frame in said parked position.

10. The pivoting docking platform for personal watercraft as set forth in claim 9 further comprising a down stop adjustment bolt screwable into a top of said down stop bracket, said down stop adjustment bolt providing a means of adjusting a lower limit of said frame in said receiving position.

11. The pivoting docking platform for personal watercraft as set forth in claim 1 in which said lock mechanism comprises a lock bracket, a lock pin and a spring, said lock bracket fixed to said stop mechanism and extending upward adjacent to said frame when said frame is in said parked position, said lock pin extending through said lock bracket and engaging said frame to lock said frame in said parked position, and said spring providing bias to bias said lock pin outward towards said frame.

* * * * *